US011566615B2

(12) United States Patent
Tanaka

(10) Patent No.: US 11,566,615 B2
(45) Date of Patent: Jan. 31, 2023

(54) PUMP AND FLUID CONTROL APPARATUS

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 5 days.

(21) Appl. No.: 16/844,329

(22) Filed: Apr. 9, 2020

(65) Prior Publication Data

US 2020/0232451 A1 Jul. 23, 2020

Related U.S. Application Data

(63) Continuation of application No. PCT/JP2018/033747, filed on Sep. 12, 2018.

(30) Foreign Application Priority Data

Oct. 10, 2017 (JP) ..... JP2017-196519

(51) Int. Cl.
*F04B 43/04* (2006.01)
*F04B 53/10* (2006.01)
*F04B 45/047* (2006.01)

(52) U.S. Cl.
CPC ..... *F04B 53/1037* (2013.01); *F04B 43/04* (2013.01); *F04B 43/046* (2013.01); *F04B 45/047* (2013.01)

(58) Field of Classification Search
CPC ..... F04B 43/04; F04B 43/043; F04B 43/046; F04B 45/04; F04B 45/045; F04B 45/047;
(Continued)

(56) References Cited

U.S. PATENT DOCUMENTS 7,972,124 B2 * 7/2011 Hirata ..... F04B 45/047 417/413.2
2008/0304979 A1 * 12/2008 Lucas ..... F04B 45/04 417/327

(Continued)

FOREIGN PATENT DOCUMENTS

JP 2012-528980 A 11/2012
JP 2017-072140 A 4/2017

(Continued)

OTHER PUBLICATIONS

International Search Report issued in Patent Application No. PCT/JP2018/033747 dated Dec. 4, 2018.

(Continued)

*Primary Examiner* — Charles G Freay
*Assistant Examiner* — Chirag Jariwala
(74) *Attorney, Agent, or Firm* — Pearne & Gordon LLP

(57) ABSTRACT

A pump includes a housing, a piezoelectric device, a plurality of first holes, a plurality of second holes, and a plurality of first valves. The housing has a pump chamber defined by a first major plate, a second major plate, and a peripheral plate. The piezoelectric device is provided on the first major plate. The plurality of first holes each extend through the first major plate and are arranged annularly. The plurality of second holes each extend through the second major plate. The plurality of first valves are provided at the plurality of first holes, respectively. When the piezoelectric device is activated, the first major plate undergoes bending vibration with a node defined between a center and a peripheral edge of the first major plate. The plurality of first holes are provided between the node and the peripheral edge.

19 Claims, 6 Drawing Sheets

(58) Field of Classification Search
CPC ..... F04B 39/102; F04B 39/1026; F04B 39/1033; F04B 53/103; F04B 53/1035; F04B 53/1085; F04B 43/00; F04B 43/0009; F04B 43/02; F04B 43/08; F04B 43/09; F04B 43/095; F04B 53/00; F04B 53/10; F04B 53/102; F04B 53/1037; F04B 53/1075; F04B 53/1077; F16K 15/142; F16K 15/1402
See application file for complete search history.

(56) References Cited

U.S. PATENT DOCUMENTS

2013/0280105 A1* 10/2013 Locke ..... F04B 17/003 417/413.2
2016/0010636 A1* 1/2016 Tanaka ..... F04B 45/047 417/413.2
2016/0076537 A1* 3/2016 Kawamura ..... F16K 7/12 137/565.11
2016/0348666 A1 12/2016 Tanaka
2016/0377073 A1* 12/2016 Tanaka ..... F04B 53/16 417/413.2
2017/0138357 A1* 5/2017 Kondo ..... F04B 49/06
2018/0187672 A1 7/2018 Tanaka et al.
2018/0306178 A1* 10/2018 Tanaka ..... F04B 45/047

FOREIGN PATENT DOCUMENTS

WO 2006111775 † 10/2006
WO 2010-139916 A1 12/2010
WO 2010139916 † 12/2010
WO 2011095795 † 8/2011
WO 2015-125608 A1 8/2015
WO WO-2016009870 A1 * 1/2016 ..... F04B 49/06
WO 2017-038565 A1 3/2017

OTHER PUBLICATIONS

Written Opinion issued in Patent Application No. PCT/JP2018/033747 dated Dec. 4, 2018.

* cited by examiner
† cited by third party

PUMP AND FLUID CONTROL APPARATUS

This is a continuation of International Application No. PCT/JP2018/033747 filed on Sep. 12, 2018, which claims priority from Japanese Patent Application No. 2017-196519 filed on Oct. 10, 2017. The contents of these applications are incorporated herein by reference in their entireties.

BACKGROUND

Technical Field

The present disclosure relates to a pump including a driving device such as a piezoelectric device, and a fluid control apparatus including a pump.

Hitherto, various pumps including piezoelectric devices and various other pumps have been put to practical use. For example, a pump disclosed by Patent Document 1 has a cavity defined by a cylindrical wall, a base, an end plate, and an isolator. The base has a primary-side opening in the center thereof. The primary-side opening is provided with a valve. The end plate has a secondary-side opening between the center and the peripheral edge thereof.

In the pump disclosed by Patent Document 1, when a piezoelectric device provided on the end plate is activated, the end plate is vibrated, whereby the volume of the cavity is changed. Thus, air is taken in through the secondary-side opening and is discharged through the primary-side opening.

Patent Document 1: Japanese Unexamined Patent Application Publication (Translation of PCT Application) No. 2012-528980

BRIEF SUMMARY

If the configuration disclosed by Patent Document 1 has only one primary-side opening provided with a valve, a satisfactory flow rate cannot be achieved. Conversely, if the configuration has many primary-side openings provided with respective valves, the length of an opening and closing movement of each of the valves is reduced, which lowers the performance of the pump in terms of discharge pressure and the like.

Accordingly, the present disclosure provides a pump exhibiting excellent pump performance in terms of flow rate, discharge pressure, and the like.

A pump according to the present disclosure includes a housing, a driving device, a plurality of first holes, a plurality of second holes, and a plurality of first valves. The housing includes a first major plate, a second major plate having a major surface that faces one of major surfaces of the first major plate, and a peripheral plate that connects the first major plate and the second major plate to each other. The housing has a pump chamber as a space defined by the first major plate, the second major plate, and the peripheral plate. The driving device is provided on the first major plate or the second major plate. The plurality of first holes, each extends through the first major plate from one of the major surfaces to the other and are arranged annularly in the first major plate in a plan view of the first major plate. The plurality of second holes, each extends through the second major plate or the peripheral plate. The plurality of first valves are provided at the plurality of first holes, respectively. When the driving device is activated, one of the first major plate and the second major plate that has the driving device undergoes bending vibration with a node defined between a center and a peripheral edge of the major plate. The plurality of first holes are provided between the node and the peripheral edge.

In such a configuration, the plurality of first valves are provided at positions where the amount of volume change in the pump chamber is large. Therefore, a flow rate higher than in the known technique can be obtained. Furthermore, since the plurality of first holes are arranged in axial symmetry, the fluid can be made to flow efficiently. Furthermore, since a plurality of second holes are provided, the passage resistance at each of the second holes can be reduced.

In the pump according to the present disclosure, the plurality of second holes can be provided in the second major plate and be arranged annularly in a plan view of one of major surfaces of the second major plate.

In such a configuration, since the plurality of second holes are arranged in axial symmetry, the fluid can be made to flow efficiently.

In the pump according to the present disclosure, the plurality of second holes may be provided with no valves.

In such a configuration, the passage resistance at the plurality of second holes can further be reduced.

In the pump according to the present disclosure, the plurality of second holes can be provided in the second major plate and overlap the node in the plan view of the second major plate.

In such a configuration, the plurality of second holes are provided at positions of the pump chamber where there is substantially no volume change. Therefore, backflow of the fluid is less likely to occur.

The pump according to the present disclosure may further include a plurality of second valves provided at the plurality of second holes, respectively.

In such a configuration, a flow-straightening effect can be produced at the plurality of second holes.

In the pump according to the present disclosure, the plurality of second holes may be provided in the peripheral plate.

In such a configuration, the plurality of second holes are provided at positions of the pump chamber where there is substantially no volume change. Therefore, backflow of the fluid is less likely to occur.

In the pump according to the present disclosure, the plurality of second holes can be provided in the second major plate and between the node and the peripheral edge of the second major plate in the plan view of the one of the major surfaces of the second major plate.

In such a configuration, the distance between each of the plurality of second holes and a corresponding one of the plurality of first holes is short. Therefore, the fluid can be made to flow efficiently.

In the pump according to the present disclosure, the plurality of second holes can overlap a loop top of the bending vibration of the second major plate in the plan view of the one of the major surfaces of the second major plate.

In such a configuration, the plurality of second holes are provided in an area of the pump chamber where there is a greater volume change. Therefore, a flow rate higher than in the known technique can be obtained.

In the pump according to the present disclosure, a second area where the plurality of second holes are provided and a first area where the plurality of first holes are provided can overlap with each other in a plan view of one of the major surfaces of either of the first major plate and the second major plate.

In such a configuration, the distance between each of the plurality of second holes and a corresponding one of the plurality of first holes becomes shorter. Therefore, the fluid can be made to flow more efficiently.

In the pump according to the present disclosure, the plurality of second holes and the plurality of first holes can overlap with each other, respectively, in the plan view of the one of the major surfaces of either of the first major plate and the second major plate.

In such a configuration, the distance between each of the plurality of second holes and a corresponding one of the plurality of first holes becomes much shorter. Therefore, the fluid can be made to flow much more efficiently.

In the pump according to the present disclosure, the plurality of first holes can overlap a loop top of the bending vibration of the first major plate in the plan view of the one of the major surfaces of the first major plate.

In such a configuration, the plurality of first holes are provided in an area of the pump chamber where there is a greater volume change. Therefore, a flow rate higher than in the known technique can be obtained.

The pump according to the present disclosure may be configured as follows. The plurality of first valves are collectively formed of an annular valve member and a cover member. The annular valve member overlaps the plurality of first holes in the plan view of the first major plate. The cover member is provided across the valve member from the first major plate.

In such a configuration, the valve structure provided to the plurality of first holes is simplified. Therefore, the probability that any microdefects may occur in the process of manufacturing the valve member is low. Accordingly, the risk of damage to the valve is low.

In the pump according to the present disclosure, each of the first major plate, the second major plate, and the driving device can have a regular polygonal shape such as a square, or a circular shape.

In such a configuration, vibration is transmitted point symmetrically. Therefore, the energy loss can be reduced.

In the pump according to the present disclosure, each of the first major plate, the second major plate, and the driving device can have a circular shape.

In such a configuration, the vibration has a high degree of axial symmetry. Therefore, the energy loss can further be reduced.

A fluid control apparatus according to the present disclosure includes any of the pumps described above, and a control unit that supplies a driving signal to the driving device, the driving signal causing the bending vibration.

In such a configuration, the above bending vibration can be controlled reliably.

The present disclosure can realize a pump exhibiting pump performance that enables fluid to flow at a higher flow rate or with a higher discharge pressure than in the known technique.

DETAILED DESCRIPTION

Figure 1A:
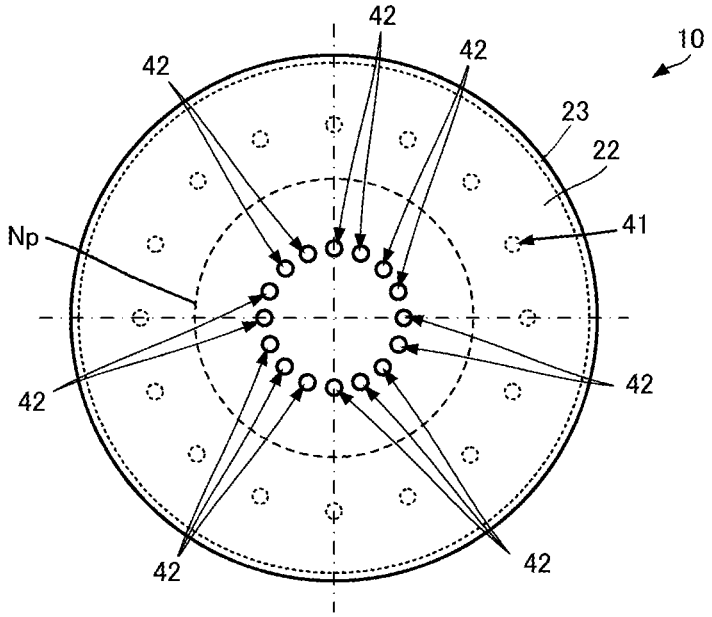
FIG. 1A is a second plan view of a pump according to a first embodiment of the present disclosure.
Figure 1B:
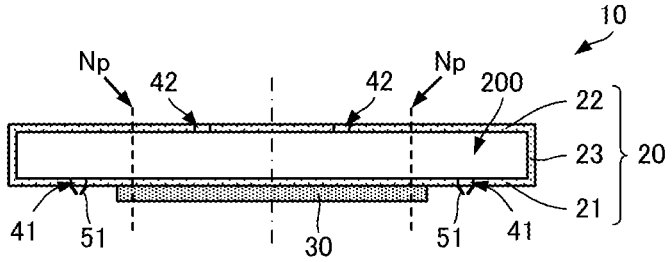
FIG. 1B is a side sectional view of the pump according to the first embodiment of the present disclosure.
Figure 1C:
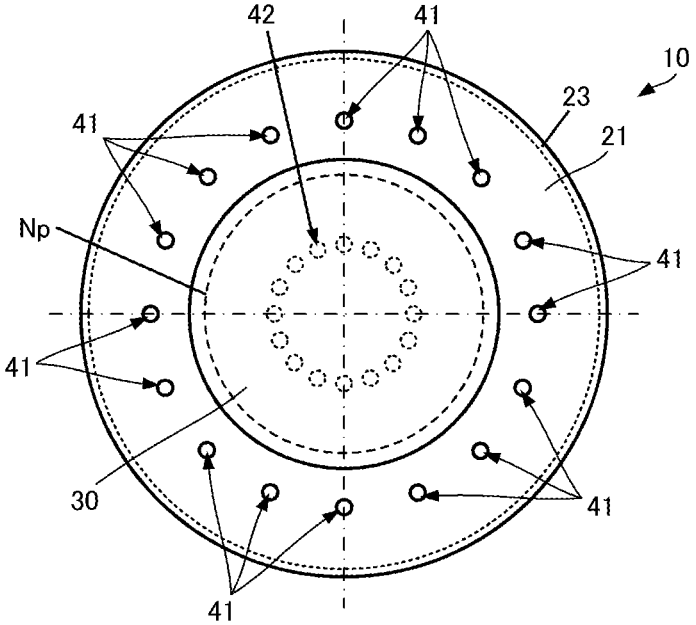
FIG. 1C is a first plan view of the pump according to the first embodiment of the present disclosure.
Figure 2A:
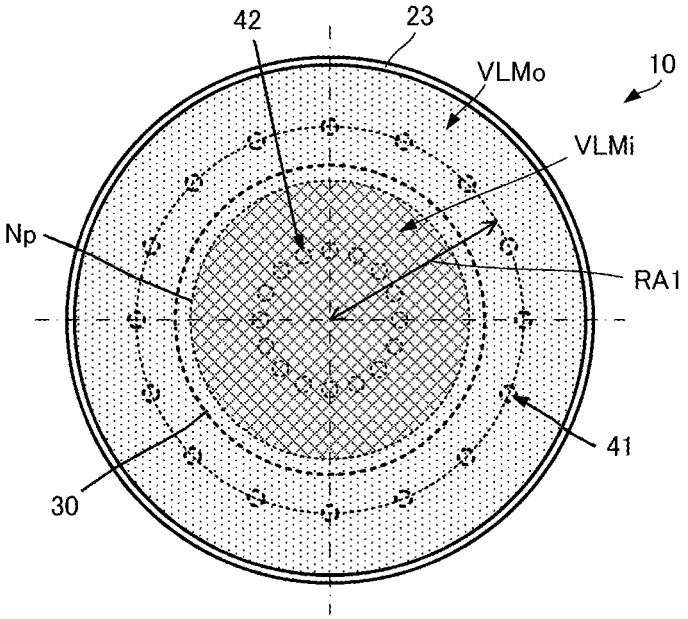
FIG. 2A is a diagram illustrating how the pump according to the first embodiment of the present disclosure is sectioned.
Figure 2B:
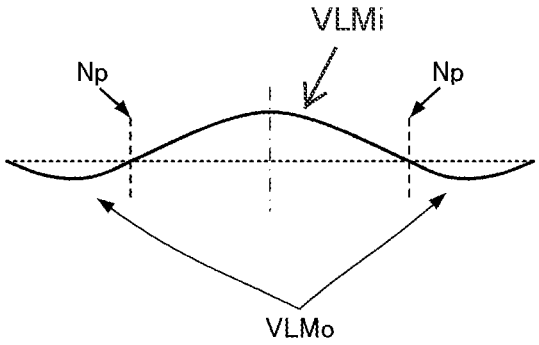
FIG. 2B is a diagram schematically illustrating how a major plate having a piezoelectric device vibrates.
Figure 3:
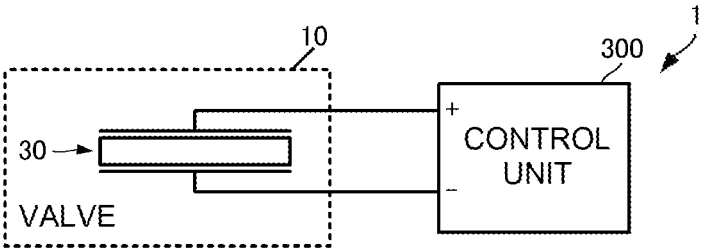
FIG. 3 is a schematic functional block diagram of a fluid control apparatus according to the first embodiment of the present disclosure.

A pump and a fluid control apparatus according to a first embodiment of the present disclosure will now be described with reference to drawings. FIG. 1A is a second plan view of a pump according to the first embodiment of the present disclosure. FIG. 1B is a side sectional view of the pump according to the first embodiment of the present disclosure. FIG. 1C is a first plan view of the pump according to the first embodiment of the present disclosure. FIG. 2A is a diagram illustrating how the pump according to the first embodiment of the present disclosure is sectioned. FIG. 2B is a diagram schematically illustrating how a major plate having a piezoelectric device vibrates. In FIG. 2B, the horizontal axis represents the position on the plane of a first major plate. The center of the horizontal axis corresponds to the center of the first major plate. Two ends of the horizontal axis, each corresponds to the peripheral edge of the first major plate. In FIG. 2B, the vertical direction corresponds to the amplitude of the vibration of the first major plate at a given moment. FIG. 3 is a schematic functional block diagram of a fluid control apparatus according to the first embodiment of the present disclosure.

As illustrated in FIGS. 1A, 1B, and 1C, a pump 10 includes a housing 20 and a piezoelectric device 30. The housing 20 includes a first major plate 21, a second major plate 22, and a peripheral plate 23.

The first major plate 21 is a circular plate. The first major plate 21 is made of a material with a thickness that is vibratable in a direction orthogonal to major surfaces thereof. The material of the first major plate 21 is, for example, stainless steel or the like. The second major plate 22 is a circular plate, as with the first major plate 21. The material of the second major plate 22 only needs to have a predetermined level of rigidity as the housing 20. The peripheral plate 23 is a cylinder. The material of the peripheral plate 23 also only needs to have a predetermined level of rigidity as the housing 20.

The peripheral plate 23 is positioned between the first major plate 21 and the second major plate 22 and connects the first major plate 21 and the second major plate 22 to each other. More specifically, in plan view (viewed in a direction perpendicular to a main surface of the first major plate 21), the centers of the first major plate 21 and the second major plate 22 coincide with each other. The peripheral plate 23 connects the first major plate 21 and the second major plate 22 arranged as above to each other over the entire peripheral edges thereof.

The housing 20 configured as above has a pump chamber 200, which is a columnar cavity defined by the first major plate 21, the second major plate 22, and the peripheral plate 23.

The piezoelectric device 30 includes a piezoelectric element in the form of a circular plate, and driving electrodes. The driving electrodes are provided on two major surfaces, respectively, of the circular-plate piezoelectric element. The material of the piezoelectric element is, for example, PZT-based ceramic.

The piezoelectric device 30 is provided on a side of the first major plate 21 that is opposite a side facing the pump chamber 200, that is, on the outside of the housing 20. In this state, the plan-view center of the piezoelectric device 30 and the plan-view center of the first major plate 21 substantially coincide with each other.

As illustrated in FIG. 3, the piezoelectric device 30 is connected to a control unit 300 included in the fluid control apparatus 1. The control unit 300 generates a driving signal for the piezoelectric device 30 and supplies the driving signal to the piezoelectric device 30. The driving signal causes the piezoelectric device 30 to expand and contract such that the first major plate 21 undergoes bending vibration with a node Np, as illustrated in FIG. 2B. For example, the vibration of the first major plate 21 has a waveform expressed by a 0th-order Bessel function of the first kind. As described above, the first major plate 21 is caused to vibrate by the piezoelectric device 30. That is, the first major plate 21 functions as a diaphragm.

As illustrated in FIGS. 1A, 1B, and 1C, the first major plate 21 has a plurality of first holes 41. The plurality of first holes 41, each extends through the first major plate 21 in the thickness direction. The plurality of first holes 41, each has an opening diameter extremely smaller than the diameter of the first major plate 21. In the plan view of the first major plate 21, the plurality of first holes 41 are arranged to form an annular shape. The center of the annular shape coincides with the center of the first major plate 21. The plurality of first holes 41 are positioned on the annular shape defined by a radius RA1 with respect to the center.

The plurality of first holes 41 are provided between the node Np and the peripheral edge of the first major plate 21.

The plurality of first holes 41 are provided with a plurality of first valves 51, respectively. The plurality of first valves 51 are opened when fluid moves from the pump chamber 200 to the outside of the housing 20 (at the time of discharge), and are closed when the fluid moves from the outside of the housing 20 into the pump chamber 200 (at the time of suction).

As illustrated in FIGS. 1A, 1B, and 1C, the second major plate 22 has a plurality of second holes 42. The plurality of second holes 42, each extends through the second major plate 22 in the thickness direction. The plurality of second holes 42, each has an opening diameter extremely smaller than the diameter of the second major plate 22. In the plan view of the second major plate 22, the plurality of second holes 42 are arranged to form an annular shape. The center of the annular shape coincides with the center of the second major plate 22. The plurality of second holes 42 are provided between the node Np and the center of the second major plate 22.

The pump 10 configured as above uses the vibration of the first major plate 21 to take the fluid into the pump chamber 200 through the plurality of second holes 42. Furthermore, the pump 10 uses the vibration of the first major plate 21 to discharge the fluid from the pump chamber 200 through the plurality of first holes 41.

Here, as illustrated in FIG. 2A, the pump chamber 200 is sectioned into a cavity area VLMi (loop top) on one side of the node Np that is nearer to the center and a cavity area VLMo (loop top) on the other side of the node Np that is nearer to the peripheral edge. As can be seen from FIG. 2A, the cavity area VLMo is larger than the cavity area VLMi.

Therefore, as illustrated in FIG. 2B, even if the absolute value of maximum vibration in the cavity area VLMo (loop top) is smaller than the absolute value of maximum vibration in the cavity area VLMi (loop top), the amount of volume change in the cavity area VLMo is greater than the amount of volume change in the cavity area VLMi. For example, as described above, if the vibration is expressed by a 0th-order Bessel function of the first kind, the amount of volume change in the cavity area VLMo is about 2.5 times the amount of volume change in the cavity area VLMi.

As described above, since the first holes 41 with the first valves 51 are provided in a portion of the first major plate 21 that defines the cavity area VLMo exhibiting the greater amount of volume change, a high flow rate is obtained. Thus, the pump 10 can achieve a high flow rate.

Moreover, the pump 10 has the plurality of second holes 42. Therefore, the passage resistance at the second major plate 22 is reduced. Hence, the pump 10 can achieve an increased flow rate.

Furthermore, the plurality of first holes 41 of the pump 10 are all at the same distance from the center of the vibration. Likewise, the plurality of second holes 42 are all at the same distance from the center of the vibration. Therefore, the pump 10 causes the fluid to move axially symmetrically. Hence, the energy loss in the fluid movement is reduced, and the pump performance is improved.

Furthermore, the plurality of second holes 42 of the pump 10 are provided with no valves. Therefore, the passage resistance at the plurality of second holes 42 is reduced. Accordingly, the pump 10 can achieve a more increased flow rate.

The above description concerns a case where the plan-view shape of the housing 20, i.e. the plan-view shapes of the first major plate 21 and the second major plate 22, is circular. Alternatively, the plan-view shape of the housing 20 (the plan-view shapes of the first major plate 21 and the second major plate 22) may be another shape, specifically a regular polygon such as a square or a polygon such as a rectangle, as long as the housing 20 can undergo bending vibration with a node Np defined at a position between the center and the peripheral edge thereof. Note that the plan-view shape of the housing 20 (the plan-view shapes of the first major plate 21 and the second major plate 22) can be a regular polygon (particularly a regular polygon with a greater number of corners) or a circle, because such a shape allows the vibration to be transmitted point symmetrically, which reduces the energy loss. In particular, if the plan-view shape is circular, the degree of axial symmetry of the vibration is further increased. Accordingly, the energy loss can further be reduced.

The plan-view shape of each of the plurality of first holes 41 and the plurality of second holes 42 is circular in the above description but is not limited thereto. Moreover, the opening area of a single first hole 41 and the opening area of a single second hole 42 may be either the same or different.

Figure 4:
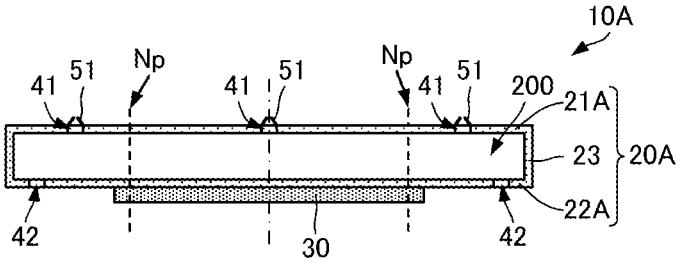
FIG. 4 is a side sectional view of a pump according to a second embodiment of the present disclosure.

Now, a pump according to a second embodiment of the present disclosure will be described with reference to a drawing. FIG. 4 is a side sectional view of a pump according to the second embodiment of the present disclosure.

A pump 10A according to the second embodiment differs from the pump 10 according to the first embodiment mainly in the position of the piezoelectric device 30. The other relevant elements of the pump 10A are the same as those of the pump 10, and description of those elements is omitted.

As illustrated in FIG. 4, the piezoelectric device 30 of the pump 10A is provided on a second major plate 22A. In plan view, the center of the piezoelectric device 30 and the center of the second major plate 22A substantially coincide with each other. The second major plate 22A is made of a vibratable material. On the other hand, a first major plate 21A only needs to be made of a material having a predetermined level of rigidity as a housing 20A.

The plurality of first holes 41 are provided in the first major plate 21A and are arranged annularly. The plurality of first holes 41 are provided between the node Np and the peripheral edge. One of the first holes 41 is provided in the center of the first major plate 21A. The plurality of first valves 51 are provided at the plurality of first holes 41, respectively.

The plurality of second holes 42 are provided near the peripheral edge of the second major plate 22A and are arranged annularly.

Even if the major plate having the first holes 41 provided with the first valves 51 and the diaphragm are modified as above, the advantageous effects produced in the first embodiment can still be obtained.

In the present embodiment, the first holes 41 provided with the first valves 51 are provided at loop tops of the bending vibration undergone by the vibratable second major plate 22A. Since the first holes 41 are provided in a part of the pump chamber where the ratio of volume change is high, the valves 51 are opened and closed with a large force, which increases the displacement of the first valves between open and closed positions. Therefore, the passage resistance generated when the first valves 51 are opened is reduced. Accordingly, the pump 10A can achieve a high flow rate.

Figure 5:
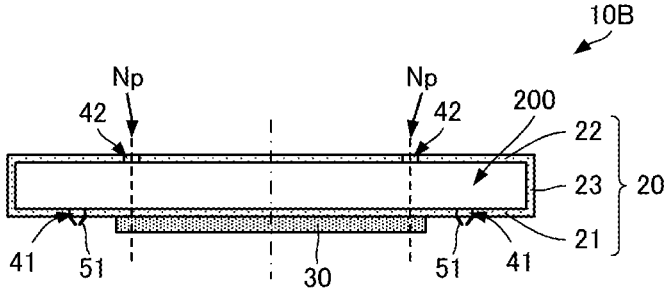
FIG. 5 is a side sectional view of a pump according to a third embodiment of the present disclosure.

Now, a pump according to a third embodiment of the present disclosure will be described with reference to a drawing. FIG. 5 is a side sectional view of a pump according to the third embodiment of the present disclosure.

A pump 10B according to the third embodiment differs from the pump 10 according to the first embodiment in the positions of the plurality of second holes 42. The other elements of the pump 10B are the same as those of the pump 10, and description of those elements is omitted.

As illustrated in FIG. 5, the plurality of second holes 42, each overlaps the node Np of the bending vibration in plan view. Herein, the situation where the second holes 42 each overlap the node Np is not limited to a situation where the center of the node Np coincides with the centers of the second holes 42 and includes a situation where the center of the node Np coincides with at least part of each of the second holes 42.

The node Np of the bending vibration expressed by a 0th-order Bessel function of the first kind or the like is close to the node of pressure vibration. Therefore, the influence brought by the plurality of second holes 42 upon the pressure change in the pump chamber 200 is small. Hence, the pump 10B can achieve a much higher flow rate. Thus, the flow rate can be increased.

Figure 6:
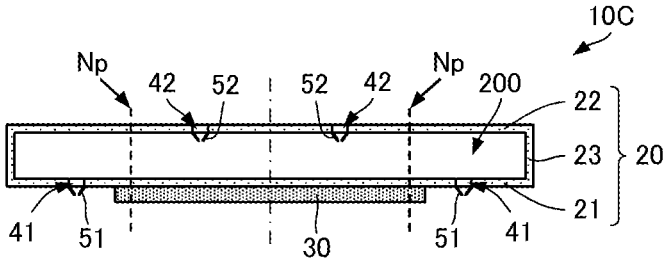
FIG. 6 is a side sectional view of a pump according to a fourth embodiment of the present disclosure.

Now, a pump according to a fourth embodiment of the present disclosure will be described with reference to a drawing. FIG. 6 is a side sectional view of a pump according to the fourth embodiment of the present disclosure.

A pump 10C according to the fourth embodiment differs from the pump 10 according to the first embodiment in including second valves 52. The other elements of the pump 10C are the same as those of the pump 10 according to the first embodiment, and description of those elements is omitted.

As illustrated in FIG. 6, the pump 10C includes a plurality of second valves 52. The plurality of second valves 52 are provided at the plurality of second holes 42, respectively. On the second major plate 22, the plurality of second valves 52 are opened when the fluid moves from the outside of the housing 20 into the pump chamber 200 (at the time of suction), and are closed when the fluid moves from the pump chamber 200 to the outside of the housing 20 (at the time of discharge).

Thus, the pump 10C can suppress the occurrence of backflow of the fluid at the second major plate 22. Accordingly, the pump 10C can generate a much higher discharge pressure.

Figure 7:
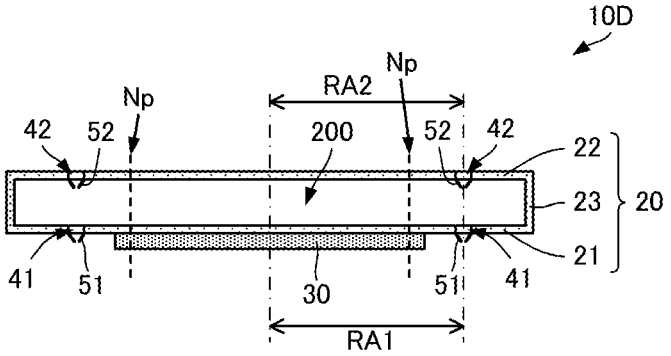
FIG. 7 is a side sectional view of a pump according to a fifth embodiment of the present disclosure.
Figure 8A:
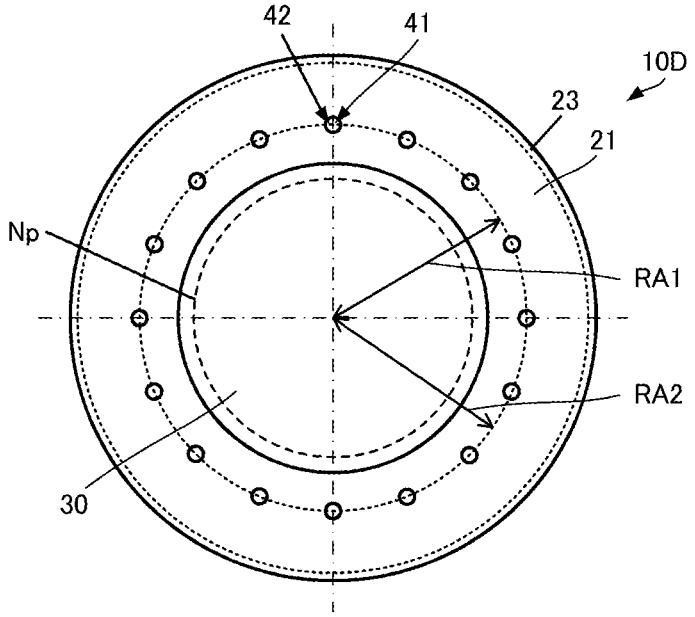
FIG. 8A is a diagram illustrating an arrangement of a plurality of second holes according to a first example.
Figure 8B:
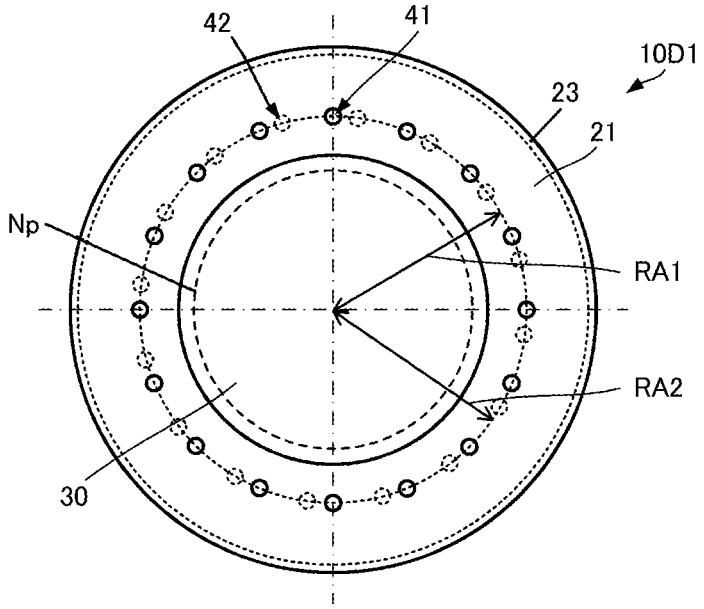
FIG. 8B is a diagram illustrating an arrangement of the plurality of second holes according to a second example.

Now, a pump according to a fifth embodiment of the present disclosure will be described with reference to drawings. FIG. 7 is a side sectional view of a pump according to the fifth embodiment of the present disclosure. FIG. 8A is a diagram illustrating an arrangement of the plurality of second holes according to a first example. FIG. 8B is a diagram illustrating an arrangement of the plurality of second holes according to a second example.

A pump 10D according to the fifth embodiment differs from the pump 10C according to the fourth embodiment in the positions of the plurality of second holes 42. The other elements of the pump 10D are the same as those of the pump 10C according to the fourth embodiment, and description of those elements is omitted.

As illustrated in FIGS. 7, 8(A), and 8(B), a radius RA2 of the arrangement pattern of the plurality of second holes 42 is equal to the radius RA1 of the arrangement pattern of the plurality of first holes 41. In the pump 10D according to the first example illustrated in FIG. 8A, the plurality of second holes 42 overlap the plurality of first holes 41, respectively, in the plan view of the housing 20. In contrast, in a pump 10D1 according to the second example illustrated in FIG. 8B, the plurality of second holes 42 do not overlap the plurality of first holes 41, respectively, in the plan view of the housing 20.

In either example, the distance between each of the plurality of second holes 42 and a corresponding one of the plurality of first holes 41 is short. Therefore, the flow resistance in the pump chamber 200 is low in both of the pumps 10D and 10D1. Accordingly, each of the pumps 10D and 10D1 can achieve a high flow rate. Furthermore, the plurality of second holes 42 of each of the pumps 10D and 10D1 are provided between the node Np and the peripheral edge of the second major plate 22. That is, the plurality of second holes 42 are provided in the cavity area exhibiting the greater amount of volume change. Since the plurality of second valves 52 suppress the occurrence of backflow, only the flow rate in the forward direction is increased. Accordingly, the pumps 10D and 10D1 can each exhibit improved pump performance.

Furthermore, in the first example, the distance between each of the plurality of second holes 42 and a corresponding one of the plurality of first holes 41 is the shortest. Therefore, the flow resistance in the pump chamber 200 of the pump 10D is much lower. Accordingly, the pump 10D can achieve a much higher flow rate.

In the configuration according to the present embodiment, each of the plurality of second holes 42 and a corresponding one of the plurality of first holes 41 may coincide with each other at least in part thereof, which is not illustrated. Herein, the situation of coincidence at least in part includes not only a situation of coincidence in the direction of arrangement of the plurality of first holes 41 and the plurality of second holes 42 (the direction along the annular shape) but also a situation of coincidence in the radial direction from the center toward the peripheral edge of the first major plate 21 or the second major plate 22. In such a configuration as well, a high flow rate can be achieved.

Figure 9:
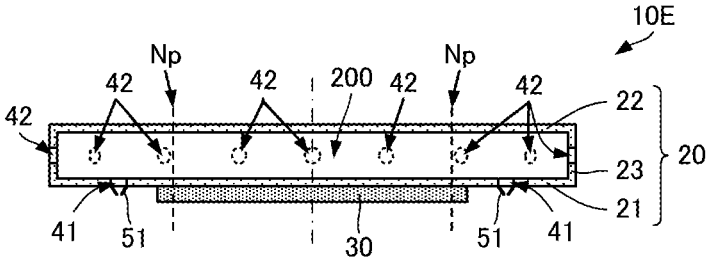
FIG. 9 is a side sectional view of a pump according to a sixth embodiment of the present disclosure.

Now, a pump according to a sixth embodiment of the present disclosure will be described with reference to a drawing. FIG. 9 is a side sectional view of a pump according to the sixth embodiment of the present disclosure.

A pump 10E according to the sixth embodiment differs from the pump 10 according to the first embodiment in the positions of the plurality of second holes 42. The other elements of the pump 10E are the same as those of the pump 10 according to the first embodiment, and description of those elements is omitted.

As illustrated in FIG. 9, the plurality of second holes 42 of the pump 10E are provided in the peripheral plate 23. The plurality of second holes 42 are arranged at intervals in the circumferential direction of the peripheral plate 23.

The peripheral plate 23 does not undergo bending vibration. Therefore, the pressure change near the surface of the peripheral plate 23 is small. Accordingly, the influence brought by the plurality of second holes 42 upon the pressure change in the pump chamber 200 is small. Hence, the fluid is less likely to flow backward through the plurality of second holes 42. Consequently, the pump 10E can achieve a much higher flow rate. Thus, the flow rate can be increased.

Furthermore, since the peripheral plate 23 is used for providing the second holes 42, the area where the second holes 42 are provided can be made larger than in the case where the second major plate 22 is used. Accordingly, a greater number of second holes 42 can be provided, and the flow rate can thus be increased.

Figure 10A:
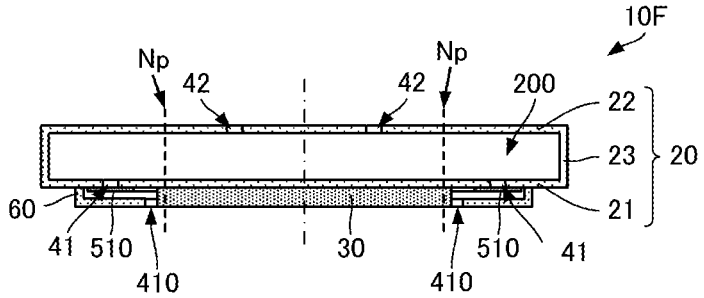
FIG. 10A is a side sectional view of a pump according to a seventh embodiment of the present disclosure.
Figure 10B:
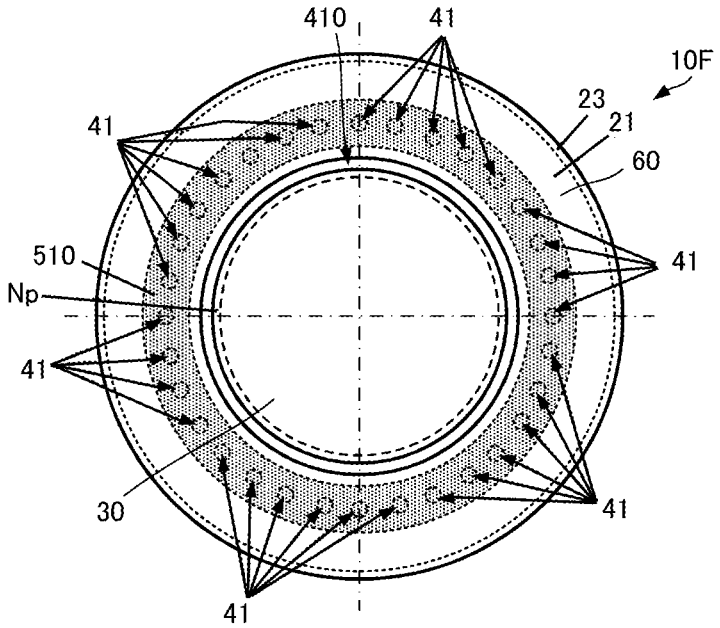
FIG. 10B is a plan view of the pump according to the seventh embodiment of the present disclosure and illustrates the arrangement and the shape of a valve member.
Figure 10C:
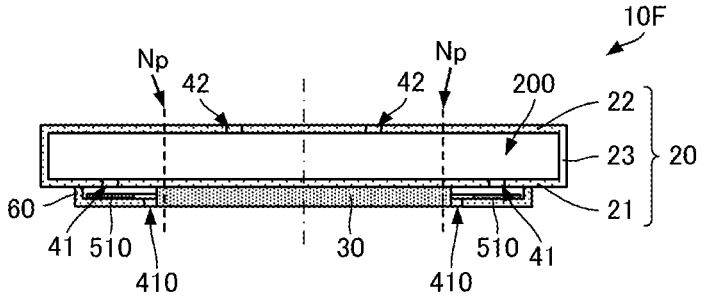
FIG. 10C is a side sectional view illustrating the position of the valve member at the time of discharge.

Now, a pump according to a seventh embodiment of the present disclosure will be described with reference to drawings. FIG. 10A is a side sectional view of a pump according to the seventh embodiment of the present disclosure. FIG. 10B is a plan view of the pump according to the seventh embodiment of the present disclosure and illustrates the arrangement and the shape of a valve member. FIG. 10C is a side sectional view illustrating the position of the valve member at the time of discharge.

A pump 10F according to the seventh embodiment differs from the pump 10 according to the first embodiment in the element serving as the plurality of first valves. The other elements of the pump 10F are the same as those of the pump 10 according to the first embodiment, and description of those elements is omitted.

As illustrated in FIGS. 10A, 10B, and 10C, the pump 10F includes a valve member 510 and a cover member 60. The valve member 510 has an annular shape (a band shape) with a predetermined width. The valve member 510 has such a shape as to cover the plurality of first holes 41 in plan view. The cover member 60 includes a major plate and a peripheral plate. The major plate of the cover member 60 is positioned across the valve member 510 from the first major plate 21. An end portion of the peripheral plate of the cover member 60 that is on a side opposite a side facing the major plate is connected to the first major plate 21. The major plate of the cover member 60 has an opening 410 with a diameter smaller than the inside diameter of the valve member 510.

When the fluid moves from the pump chamber 200 to the outside of the housing 20 through the plurality of first holes 41, the valve member 510 moves toward the major plate of the cover member 60 as illustrated in FIG. 10C. The fluid moving toward the outside flows through the opening provided in the major plate of the cover member 60. Conversely, when the fluid is about to move from the outside into the pump chamber 200 through the plurality of first holes 41, the valve member 510 closes the plurality of first holes 41 as illustrated in FIG. 10A. Therefore, the movement of the fluid from the outside into the pump chamber 200 is suppressed.

Such a configuration also produces the advantageous effects produced by the configuration described above in which the first valves 51 are provided at the respective first holes 41. In addition, the present configuration can reduce the distance between adjacent ones of the plurality of first holes 41. Accordingly, a greater number of first holes 41 can be provided, and the flow rate can thus be increased. Furthermore, the valve member 510 employed in the present configuration is a large component. Such a valve member can have higher strength than each of the first valves 51 provided at the respective first holes 41. Therefore, the occurrence of damage to the valve can be suppressed. Accordingly, the pump 10F can provide high reliability. Moreover, since the valve member 510 has a simple plan-view shape, the risk of microdefects that may occur in the manufacturing process is low, which also suppresses the occurrence of damage to the valve.

Figure 11:
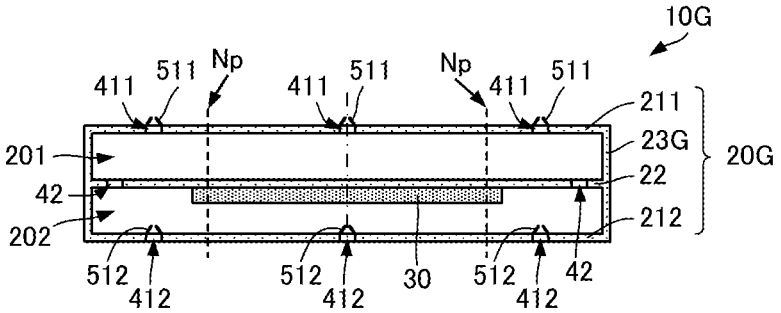
FIG. 11 is a side sectional view of a pump according to an eighth embodiment of the present disclosure.

Now, a pump according to an eighth embodiment of the present disclosure will be described with reference to a drawing. FIG. 11 is a side sectional view of a pump according to the eighth embodiment of the present disclosure.

A pump 10G according to the eighth embodiment is obtained by connecting two pumps 10A according to the second embodiment in such a manner as to stack one on top of the other. Description of the basic configuration of the pump 10G is omitted.

The pump 10G includes a housing 20G. The housing 20G includes first major plates 211 and 212, a second major plate 22, and a peripheral plate 23G. A piezoelectric device 30 is provided on the second major plate 22.

The first major plate 211, the second major plate 22, and the peripheral plate 23G define a pump chamber 201. The first major plate 212, the second major plate 22, and the peripheral plate 23G define a pump chamber 202. The pump chamber 201 and the pump chamber 202 communicate with each other through a plurality of second holes 42 provided in the second major plate 22. The first major plate 211 has a plurality of first holes 411. The first major plate 212 has a plurality of first holes 412.

The plurality of first holes 411 are provided with a plurality of first valves 511, respectively. On the first major plate 211, the plurality of first valves 511 are opened when the fluid moves from the pump chamber 201 to the outside of the housing 20G (at the time of discharge), and are closed when the fluid moves from the outside of the housing 20G into the pump chamber 201 (at the time of suction).

The plurality of first holes 412 are provided with a plurality of first valves 512, respectively. On the first major plate 212, the plurality of first valves 512 are opened when the fluid moves from the outside of the housing 20G into the pump chamber 202 (at the time of suction), and are closed when the fluid moves from the pump chamber 202 to the outside of the housing 20G (at the time of discharge).

The pump 10G configured as above takes in the fluid through the plurality of first holes 412, allows the fluid to flow through the pump chamber 202 and the pump chamber 201, and discharges the fluid through the plurality of first holes 411. Thus, the pump 10G can serve as a two-stage series pump and can generate a much higher discharge pressure.

Note that either of the plurality of first holes 411 and the plurality of first holes 412 may not necessarily need to be provided between the node Np and the peripheral edge. However, if either of the plurality of first holes 411 and the plurality of first holes 412 are provided between the node Np and the peripheral edge, the pump performance can further be improved.

Figure 12A:
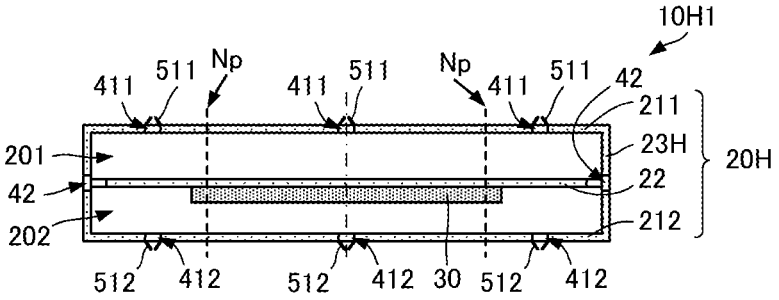
FIG. 12A is a side sectional view of a pump according to a first example of a ninth embodiment of the present disclosure.
Figure 12B:
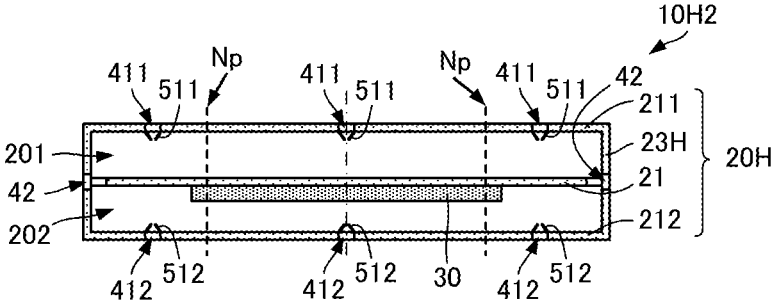
FIG. 12B is a side sectional view of a pump according to a second example of the ninth embodiment of the present disclosure.

Now, a pump according to a ninth embodiment of the present disclosure will be described with reference to drawings. FIG. 12A is a side sectional view of a pump according to a first example of the ninth embodiment of the present disclosure. FIG. 12B is a side sectional view of a pump according to a second example of the ninth embodiment of the present disclosure.

Each of pumps 10H1 and 10H2 according to the ninth embodiment differs from the pump 10G according to the eighth embodiment in the shape and the positions of the plurality of second holes and in the orientation of the plurality of first valves. The other elements of the pumps 10H1 and 10H2 are the same as those of the pump 10G, and description of those elements is omitted. A housing 20H has the same configuration as the housing 20G.

As illustrated in FIG. 12A, each of the plurality of second holes 42 of the pump 10H1 extends through not only the second major plate 22 but also a peripheral plate 23H.

On the first major plate 211, the plurality of first valves 511 are opened when the fluid moves from the pump chamber 201 to the outside of the housing 20H (at the time of discharge), and are closed when the fluid moves from the outside of the housing 20H into the pump chamber 201 (at the time of suction).

On the first major plate 212, the plurality of first valves 512 are opened when the fluid moves from the pump chamber 202 to the outside of the housing 20G (at the time of discharge), and are closed when the fluid moves from the outside of the housing 20H into the pump chamber 202 (at the time of suction).

The pump 10H1 configured as above discharges the fluid through the plurality of first holes 411 and the plurality of first holes 412 and takes the fluid into the pump chamber 201 and the pump chamber 202 through the plurality of second holes 42. Thus, the pump 10H1 can serve as a two-stage parallel pump and can realize a much higher flow rate.

As illustrated in FIG. 12B, each of the plurality of second holes 42 of the pump 10H2 extends through not only the second major plate 22 but also the peripheral plate 23H.

On the first major plate 211, the plurality of first valves 511 are opened when the fluid moves from the outside of the housing 20H into the pump chamber 201 (at the time of suction), and are closed when the fluid moves from the pump chamber 201 to the outside of the housing 20H (at the time of discharge).

On the first major plate 212, the plurality of first valves 512 are opened when the fluid moves from the outside of the housing 20H into the pump chamber 202 (at the time of suction), and are closed when the fluid moves from the pump chamber 202 to the outside of the housing 20H (at the time of discharge).

The pump 10H2 configured as above discharges the fluid through the plurality of second holes 42 and takes the fluid into the pump chamber 201 and the pump chamber 202 through the plurality of first holes 411 and the plurality of first holes 412. Thus, the pump 10H2 can serve as a two-stage parallel pump and can realize a much higher flow rate.

The above description does not specifically refer to a reference frequency f of the vibration undergone by the first major plate. However, if the reference frequency f is close to a pressure-resonance frequency fp, that is, if the following condition is satisfied, a standing wave of pressure is generated in the pump chamber. In that case, the pressure change in the pump chamber is amplified by the vibration of the first major plate. Thus, the amplitude of pressure vibration is increased.

[Math. 1]

$$f \cong fp = \frac{ck_0}{2\pi a} \tag{1}$$

In the above expression, c denotes the acoustic velocity (340 m/sec. in air) of the fluid, a denotes the radius of the pump chamber, and $k_0$ denotes a constant. The radius a and the constant $k_0$ are set as follows.

If any opening with a valve is provided at the outermost position of the pump chamber, the radius a of the pump chamber corresponds to the radius of the inner circumference of the peripheral plate. In that case, $k_0$ is a constant satisfying $J'(k_0)=0$ and is, for example, 3.83, 7.02, 10.17, or the like.

If any opening without a valve is provided at the outermost position of the pump chamber, the radius "a" of the pump chamber corresponds to the radius of a circle connecting the centers of gravity of the plurality of openings. In that case, $k_0$ is a constant satisfying $J(k_0)=0$ and is, for example, 2.40, 5.02, 8.65, or the like.

If the following expression is satisfied, the amplitude of pressure change becomes particularly large because the standing wave of pressure is generated.

[Math. 2]

$$\frac{5}{6}\cdot\frac{ck_0}{2\pi a} < f < \frac{7}{6}\cdot\frac{ck_0}{2\pi a} \tag{2}$$

The above condition is established by the following logic, for example.

When the first major plate vibrates, the distance between the first major plate and the second major plate in the pump chamber increases and decreases, whereby a pressure wave is generated. The pressure wave propagates in the pump chamber in directions toward the peripheral plate of the housing and is reflected by the peripheral plate. In this process, another pressure wave is also generated in the pump chamber. Therefore, if the newly generated pressure wave and the reflected pressure wave have respective phases that do not cancel each other out, that is, if the two pressure waves vibrate sympathetically with each other, the fluid in the pump chamber resonates, generating a standing wave of pressure. Consequently, the pressure changes with a large amplitude.

Under such phase conditions, the pressure in the pump chamber is calculated theoretically by letting the phase difference be θ and the reflectance at the peripheral plate be r. To cause resonance, an expression cos θ>r/2 only needs to be satisfied. Here, since the reflectance r is slightly smaller than 1, an expression $-60° < \theta < +60°$ is established.

That is, the driving frequency (≈ reference frequency) f only needs to satisfy the following expression with respect to the pressure-resonance frequency fp derived by the Bessel function.

[Math. 3]

$$\frac{5}{6} \cdot fp < f < \frac{7}{6} \cdot fp \quad (3)$$

Hence, Expression (2) above only needs to be satisfied.

While each of the above embodiments concerns a case where the piezoelectric device is provided only on one of the first major plate and the second major plate, the piezoelectric device may be provided on each of the first major plate and the second major plate. In that case, the amount of volume change in the pump chamber is increased. Accordingly, the flow rate and the discharge pressure of the pump are increased.

While each of the above embodiments concerns a case where the piezoelectric device is provided only on one of the major surfaces of the first major plate or the second major plate, the piezoelectric device may be provided on each of the major surfaces of the major plate. In that case, the amount of volume change in the pump chamber is increased. Accordingly, the flow rate and the discharge pressure of the pump are increased.

While each of the above embodiments concerns a case where a piezoelectric device is employed as the driving device that causes the first major plate or the second major plate to undergo bending vibration, another driving device such as a voice coil motor or a bimetal may be employed.

The configurations according to the above embodiments may be combined according to need. Such combinations each produce corresponding advantageous effects.

REFERENCE SIGNS LIST

1: fluid control apparatus
10, 10A, 10B, 10C, 10D, 10D1, 10E, 10F, 10G, 10H1, 10H2: pump
20, 20A, 20G, 20H: housing
21, 21A, 211, 212: first major plate
22, 22A: second major plate
23, 23G, 23H: peripheral plate
30: piezoelectric device
41, 411, 412: first hole
42: second hole
51, 511, 512: first valve
52: second valve
60: cover member
200, 201, 202: pump chamber
300: control unit
410: opening
510: valve member
Np: node
RA1: radius
RA2: radius
VLMi: cavity area
VLMo: cavity area

The invention claimed is:

1. A pump comprising:

a housing including a first major plate, a second major plate having a major surface that faces one of major surfaces of the first major plate, and a peripheral plate that connects the first major plate and the second major plate to each other, the housing having a pump chamber defined by the first major plate, the second major plate, and the peripheral plate;

a driving device provided on the first major plate or the second major plate;

a plurality of first holes each extending through the first major plate and arranged annularly in a plan view of the first major plate;

a plurality of second holes each extending through the second major plate or the peripheral plate; and a plurality of first valves provided at the plurality of first holes, respectively, wherein when the driving device is activated, one of the first major plate and the second major plate that has the driving device undergoes bending vibration with a node defined between a center and a peripheral edge of the one of the first major plate and the second major plate that has the driving device, and wherein when viewed in a direction perpendicular to the first major plate, a center of each of the plurality of first holes is provided at a position that is further away from the center of the first major plate than the node and inside of the peripheral edge of the first major plate when the driving device is provided on the first major plate, and a center of each of the plurality of first holes is provided at a position that is further away from a center of the first major plate than the node and inside of a peripheral edge of the first major plate when the driving device is provided on the second major plate, wherein the plurality of first valves collectively comprises:

an annular valve member overlapping the plurality of first holes in the plan view of the first major plate, and a cover member provided across the annular valve member from the first major plate.

2. The pump according to claim 1, wherein the plurality of first holes overlap a loop top of the bending vibration in a plan view of the one of the major surfaces of the first major plate.

3. The pump according to claim 1, wherein each of the first major plate, the second major plate, and the driving device has a circular shape.

4. A fluid control apparatus comprising:

The pump according to claim 1; and a control unit that supplies a driving signal to the driving device, the driving signal causing the bending vibration.

5. The pump according to claim 1, wherein the driving device is provided on the first major plate.

6. The pump according to claim 1, wherein the plurality of second holes are arranged annularly in a plan view of one of major surfaces of the second major plate.

7. The pump according to claim 6, wherein the plurality of second holes are provided with no valves.

8. The pump according to claim 6, further comprising:

a plurality of second valves provided at the plurality of second holes, respectively.

9. The pump according to claim 6, wherein the plurality of first holes overlap a loop top of the bending vibration in a plan view of the one of the major surfaces of the first major plate.

10. The pump according to claim 1, wherein the plurality of second holes are provided with no valves.

11. The pump according to claim 10, wherein the plurality of second holes are provided in the second major plate and overlap the node in a plan view of one of major surfaces of the second major plate.

12. The pump according to claim 10, wherein the plurality of second holes are provided in the peripheral plate.

13. The pump according to claim 10, wherein the plurality of first holes overlap a loop top of the bending vibration in a plan view of the one of the major surfaces of the first major plate.

14. The pump according to claim 1, further comprising:

a plurality of second valves provided at the plurality of second holes, respectively.

15. The pump according to claim 14, wherein the plurality of second holes are provided in the second major plate and between the node and a peripheral edge of the second major plate in a plan view of one of major surfaces of the second major plate when the driving device is provided on the first major plate, and the plurality of second holes are provided in the second major plate and between the node and the peripheral edge of the second major plate in a plan view of one of major surfaces of the second major plate when the driving device is provided on the second major plate.

16. The pump according to claim 15, wherein the plurality of second holes overlap a loop top of the bending vibration in the plan view of the one of the major surfaces of the second major plate.

17. The pump according to claim 16, wherein a second area where the plurality of second holes are provided and a first area where the plurality of first holes are provided overlap with each other in a plan view of the one of the major surfaces of the first major plate or the plan view of the one of the major surfaces of the second major plate.

18. The pump according to claim 15, wherein a second area where the plurality of second holes are provided and a first area where the plurality of first holes are provided overlap with each other in a plan view of the one of the major surfaces of the first major plate and the plan view of the one of the major surfaces of the second major plate.

19. The pump according to claim 18, wherein the plurality of second holes and the plurality of first holes overlap with each other, respectively, in the plan view of the one of the major surfaces of either of the first major plate and the second major plate.

* * * * *